US006298683B1

(12) United States Patent
Kondo et al.

(10) Patent No.: US 6,298,683 B1
(45) Date of Patent: Oct. 9, 2001

(54) REFRIGERATING DEVICE

(75) Inventors: Isao Kondo; Akitoshi Ueno; Takenori Mezaki, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/622,061

(22) PCT Filed: Feb. 14, 1999

(86) PCT No.: PCT/JP99/07025

§ 371 Date: Aug. 25, 2000

§ 102(e) Date: Aug. 25, 2000

(87) PCT Pub. No.: WO00/39510

PCT Pub. Date: Jul. 6, 2000

(30) Foreign Application Priority Data

Dec. 25, 1998 (JP) ..... 10-369514

(51) Int. Cl.[7] ..... F25B 7/00
(52) U.S. Cl. ..... 62/335
(58) Field of Search ..... 62/335

(56) References Cited

U.S. PATENT DOCUMENTS

| | | | | |
|---|---|---|---|---|
| 3,102,399 | * | 9/1963 | Meckler | 62/335 |
| 3,852,974 | * | 12/1974 | Brown | 62/335 |
| 4,402,189 | * | 9/1983 | Schaeffer | 62/335 |
| 4,878,357 | | 11/1989 | Sekigami et al. . | |

FOREIGN PATENT DOCUMENTS

| | | |
|---|---|---|
| 58-66762 | 4/1983 | (JP) . |
| 58-178159 | 10/1983 | (JP) . |
| 1-247967 | 10/1989 | (JP) . |
| 3-111870 | 11/1991 | (JP) . |
| 9-138046 | 5/1997 | (JP) . |
| 9-210515 | 8/1997 | (JP) . |
| 10-103800 | 4/1998 | (JP) . |

* cited by examiner

*Primary Examiner*—William E. Tapolcai
*Assistant Examiner*—Mohammad M Ali
(74) *Attorney, Agent, or Firm*—Nixon Peabody LLP; Donald R. Studebaker

(57) ABSTRACT

A first refrigeration circuit for a refrigerating apparatus which is formed into a two-stage cascade refrigerating cycle by establishing connection between a high temperature-side refrigerant circuit and a low temperature-side refrigerant circuit through a refrigerant heat exchanger, and a second refrigeration circuit which is formed into a refrigerating cycle different from that of the first refrigeration circuit are provided. A liquid piping line of the high temperature-side refrigerant circuit and a liquid piping line of the second refrigeration circuit are connected together through a first connection piping line and a suction-side gas piping line of the high temperature-side refrigerant circuit and a suction-side gal line of the second refrigeration circuit are connected together through a second connection piping line. Switching members are disposed for selective circulation of a refrigerant of the second refrigeration circuit to the refrigerant heat exchanger of the first refrigeration circuit through each of the connection piping lines, whereby, even when a heat source equipment stops operating in a two-stage cascade refrigerating cycle refrigeration system applied to a showcase or the like, it becomes possible to achieve continuation of refrigeration operation.

6 Claims, 8 Drawing Sheets

REFRIGERATING DEVICE

TECHNICAL FIELD

The present invention relates to a refrigeration system and more particularly to a technique for continuation of refrigeration operation in the event that a heat source equipment stops in a two-stage cascade refrigerating cycle refrigeration system.

BACKGROUND ART

As disclosed in Japanese Unexamined Patent Gazette No. H09-210515, there is a conventional refrigeration system which is formed into a two-stage cascade refrigerating cycle of the vapor compression type by connecting together a high temperature-side refrigerant circuit and a low temperature-side refrigerant circuit through a refrigerant heat exchanger. More specifically, the high temperature-side refrigerant circuit, on the one hand, comprises a closed circuit formed by sequential connection, established by refrigerant piping, of a compressor, a heat source-side heat exchanger, an expansion valve, and an evaporation portion of a refrigerant heat exchanger. On the other hand, the low temperature-side refrigerant circuit comprises a closed circuit formed by sequential connection, established by refrigerant piping, of a compressor, a condensation portion of the refrigerant heat exchanger, an expansion valve, and an application-side heat exchanger.

Such a two-stage cascade refrigerating cycle refrigeration system finds applications in refrigerating apparatus such as showcases for foods or the like installed at stores (e.g., super markets and convenience stores). Defined in such a showcase are a display space for frozen foods in the showcase chamber and an air passage for the circulation of air with the display space. The application-side heat exchanger, which is disposed in the air passage, is able to provide a supply of air into the showcase chamber with the aid of an air blower.

During the operation of the showcase, refrigerants are circulated in the high temperature-side refrigerant circuit and in the low temperature-side refrigerant circuit, wherein heat exchange is carried out between the refrigerants of these two refrigerant circuits in the refrigerant heat exchanger. With regard to the low temperature-side refrigerant circuit, a refrigerant discharged out of the compressor condenses in the refrigerant heat exchanger, decompresses in the expansion valve, and thereafter evaporates by heat exchange with air flowing through the air passage in the application-side heat exchanger in the showcase, whereby the air is cooled. Then, the cooled air is supplied, through the air passage, into the display space in the showcase chamber. In this way, foods are preserved at a predefined low temperature to maintain their freshness.

However, in such a conventional showcase constructed in the way described above, the operation will be brought into a stop when there occurs a failure in some equipment on the heat source side (e.g., the compressor), even though the application-side equipments are normally operating. There are some possible means of coping with such stoppage, one of which is to transfer the goods to another showcase that remains in operation. This, however, results in an increase in the load of refrigerating/cooling, therefore producing the problem of making it impossible to maintain the quality of goods at a satisfactory level. Particularly, in the case a freezing showcase stops, this produces the problem that the stored goods cannot be preserved at a satisfactory level of quality even when transferred into a cold storage showcase.

Bearing in mind the above-described problems, the present invention was made. Accordingly, an object of the present invention is to maintain the quality of goods by achieving continuation of refrigeration operation even when a heat source-side equipment stops in a two-stage cascade refrigerating cycle refrigeration system applied to a showcase or the like.

DISCLOSURE OF INVENTION

In accordance with the present invention, even when in a two-stage cascade refrigerating cycle refrigeration system an equipment on the heat source side stops, the operation can be continued by temporarily providing a supply of refrigerant from a refrigeration circuit disposed in, for example, air conditioning apparatus to a refrigerant heat exchanger of the refrigeration system.

The present invention provides first solving means comprising a first refrigeration circuit (1) for a refrigerating apparatus (6A) which is formed into a two-stage cascade refrigerating cycle by establishing connection between a high temperature-side refrigerant circuit (3) and a low temperature-side refrigerant circuit (4) through a refrigerant heat exchanger (5), and a second refrigeration circuit (2) which is formed into a refrigerating cycle different from that of the first refrigeration circuit (1). A liquid piping line **(15*a*) of the high temperature-side refrigerant circuit (3) and a liquid piping line (36*a*) of the second refrigeration circuit (2) are connected together through a first connection piping line (41) and a suction-side gas piping line (15*b*) of the high temperature-side refrigerant circuit (3) and a suction-side gas piping line (36*b*) of the second refrigeration circuit (2) are connected together through a second connection piping line (42), and the first solving means further comprises switching means (43, 44) for selective circulation of a refrigerant of the second refrigeration circuit (2) to the refrigerant heat exchanger (5) of the first refrigeration circuit (1) through each of the connection piping lines (41, 42)**.

The second refrigeration circuit (2) is not limited to a refrigeration circuit for air conditioning apparatus. In the first solving means, any other refrigeration circuit of any refrigerating cycle provided in the facilities where a refrigeration system of the present invention is installed may be employed. However, in second solving means of the present invention, the second refrigeration circuit (2) is a refrigeration circuit for air conditioning apparatus.

The present invention further provides third solving means according to the first solving means, in which the refrigerant heat exchanger (5) is able to provide a supply of air to the chamber inside of the refrigerating apparatus (6A) by means of an air blower. In such a construction, the refrigerant heat exchanger (5) may be arranged either in the chamber inside of the refrigerating apparatus (6A) or in a position facing the chamber inside thereof for a direct supply of air. Alternatively, an arrangement may be made in which the refrigerant heat exchanger (5) is disposed exterior to the chamber of the refrigerating apparatus (6A) to provide a supply of air to the chamber inside through a duct or the like.

The present invention further provides fourth solving means according to the first solving means, in which the first refrigeration circuit (1) has an application-side heat exchanger (19) connected in parallel to the refrigerant heat exchanger (5).

The present invention further provides fifth solving means according to the first solving means, in which the second refrigeration circuit (2) is formed into a single-stage refrigerating cycle.

The present invention further provides sixth solving means comprising a plurality of refrigeration circuits (1) for refrigerating apparatus (6A, 6B), wherein each of the plurality of refrigeration circuits (1) is formed into a two stage cascade refrigerating cycle by establishing connection between a high temperature-side refrigerant circuit (3) and a low temperature-side refrigerant circuit (4) through a refrigerant heat exchanger (5) and wherein the high temperature-side refrigerant circuit (3) has an application-side heat exchanger (19) connected in parallel to the refrigerant heat exchanger (5).

The present invention provides seventh solving means according to the sixth solving means, wherein the application-side heat exchangers (19) included in the high temperature-side refrigerant circuits (3) of the plurality of refrigeration circuits (1) each are able to provide a supply of air to the chamber inside of one of the refrigerating apparatus (i.e., the refrigerating apparatus (6B)) by means of an air blower and wherein second application-side heat exchangers (24) included in the low temperature-side refrigerant circuits (4) of the plurality of refrigeration circuits (1) each are able to provide a supply of air to the chamber inside of the other of the refrigerating apparatus (i.e., the refrigerating apparatus (6A)) by means of an air blower.

In the first solving means, during normal operation, the chamber inside of a refrigerating apparatus such as the freezing showcase (6A) is maintained at a predetermined low temperature by two-stage cascade refrigerating cycle running operations in the first refrigeration circuit (1). On the other hand, in the case that the heat source equipment (11) employed in the high temperature-side refrigerant circuit (3) of the first refrigeration circuit (1) stops operating due to failure or the like, it is possible to flow a refrigerant of the second refrigeration circuit (2) which is formed into, for example, a single-stage refrigerating cycle into the refrigerant heat exchanger (5) of the first refrigeration circuit (1) through each of the connection piping lines (41, 42) by means of the switching means (43, 44). This therefore forms a temporary high temperature-side refrigerant circuit between the heat source equipment (31) of the second refrigeration circuit (2) and the refrigerant heat exchanger (5), whereby the operation can be continued in the low temperature-side refrigerant circuit (4) in the same manner as in the normal operating state.

Further, in the second solving means, the refrigeration circuit (2) for air conditioning apparatus installed in various stores such as a supermarket and a convenience store is utilized to enable a refrigerating apparatus such as the showcase (6A) to continue operating.

Furthermore, in the third solving means, for example, even when the compressor (22) of the low temperature-side refrigerant circuit (4) stops operating, if an air blower of the refrigerant heat exchanger (5) is operated while letting refrigerant circulate only in the high temperature-side refrigerant circuit (3), this achieves heat exchange between the refrigerant and air at the refrigerant heat exchanger (5) to generate low temperature air. This low temperature air is then supplied to the chamber inside of the showcase (6A) or the like.

Further, in the fourth solving means, the first refrigeration circuit (1) has a two-stage cascade refrigerating cycle circuit and a single-stage refrigerating cycle circuit in parallel fashion, which therefore makes it possible for the first refrigeration circuit (1) to drive refrigerating apparatus of different temperature zones, e.g., the freezing showcase (6A) and the cold storage showcase (6B). Additionally, even when the heat source equipment (11) stops, it is possible to allow each of the refrigerating apparatus (6A, 6B) having different temperature zones to continue operating without a stop by making utilization of the second refrigeration circuit (2).

Further, in the sixth solving means, each of the plural refrigeration circuits (1) has a two-stage cascade refrigerating cycle circuit and a single-stage refrigerating cycle circuit in parallel fashion, so that each refrigerating circuit (1) is able to drive refrigerating apparatus of different temperature zones, e.g., the freezing showcase (6A) and the cold storage showcase (6B). Because of such arrangement, even when the heat source equipment (11) of either one of the refrigeration circuits (1) stops due to failure or the like, it is possible for the refrigerating apparatus (6A, 6B) having different temperature zones to continue operating in the remaining refrigeration circuit (1).

Further, in the seventh solving means, air can be sent to the chamber inside of one refrigerating apparatus such as the cold storage showcase (6B) from the application-side heat exchangers (19) included in the high temperature-side refrigerant circuits (3) of a plurality of the refrigeration circuits (1), and air can be sent to the chamber inside of the other refrigerating apparatus such as the freezing showcase (6A) from the second application-side heat exchangers (24) included in the low temperature-side refrigerant circuits (4) of the plural refrigeration circuits (1), as a result of which arrangement, even when the heat source equipment (11) of either one of the refrigeration circuits (1) stops operating, the respective refrigerating equipments such as the freezing showcase (6A) and the cold storage showcase (6B) can continue operating.

In accordance with the first solving means, at the time when the heat source equipment (11) in use by the high temperature-side refrigerant circuit (3) of the first refrigeration circuit (1) stops operating due to failure or the like, it is possible to form a temporary high temperature-side refrigerant circuit between the heat source equipment (31) of the second refrigeration circuit (2) of, for example, a single-stage refrigerating cycle and the refrigerant heat exchanger (5), to provide a supply of refrigerant to the refrigerant heat exchanger (5) for continuation of two-stage cascade refrigerating cycle operation. Accordingly, the freezing showcase (6A) or the like can continue its operation. Therefore, without having to transfer foods or the like displayed in the freezing showcase (6A) to another showcase, it is possible to temporarily maintain the quality. Moreover, since there is no need to transfer foods or the like to a different showcase, this prevents the load thereof from increasing.

Further, in accordance with the second solving means, even when the heat source equipment (11) for the freezing showcase (6A) or the like at, for example, a convenience store stops operating, it is possible to temporarily maintain the quality of foods or the like displayed in the showcase (6A) by making utilization of the second refrigeration circuit (2) for air conditioning apparatus.

Furthermore, in accordance with the third solving means, even when the compressor (22) of the low temperature-side refrigerant circuit (4) stops operating, it is arranged such that a single-stage refrigerating cycle refrigeration operation can be performed by making utilization of the refrigerant heat exchanger (5). Although the temperature of the chamber inside of the freezing showcase (6A) somewhat increases (since the operation takes place only at the high-stage side), it becomes possible to prevent foods or the like from rapidly dropping in their quality.

Further, in accordance with the fourth solving means, even when the heat source equipment (11) of the first refrigeration circuit (1) stops, it is possible to temporarily maintain the quality of foods or the like in the chamber inside of refrigerating apparatus of different set temperatures such as the freezing showcase (6A) and the cold storage showcase (6B).

Furthermore, in accordance with the sixth solving means, even when the heat source equipment (11) stops operating in either one of the refrigeration circuits (1) due to failure or the like, it is possible to allow refrigerating apparatus of different set temperatures such as the freezing showcase (6A) and the cold storage showcase (6B) to continue operating by means of the remaining one refrigeration circuit (1). Since any freezing showcase does not stop operating, it is easy to maintain the quality of goods.

Finally, in accordance with the seventh solving means, for example, it is possible to provide a supply of air to the chamber inside of one cold storage showcase (6B) from a plurality of the application-side heat exchangers (19), and it is possible to provide a supply of air to the chamber inside of one freezing showcase (6A) from a plurality of the second application-side heat exchangers (24). Accordingly, even when the heat source equipment (11) of one refrigeration circuit (1) stops to cause either an application-side heat exchanger (19) or second application-side heat exchanger (24) in each showcase (6A, 6B) to stop functioning, it is possible to allow each showcase (6A, 6B) to continue operating by making use of another application-side heat exchanger (19) or second application-side heat exchanger (24) of the other refrigeration circuit (1). Because of this, without having to move the foods into another showcase, it is possible to maintain their quality.

BEST MODE FOR CARRYING OUT THE INVENTION

Hereinafter, a first embodiment of the present invention will be described in detail by making reference to the accompanying drawing figures.

Figure 1:
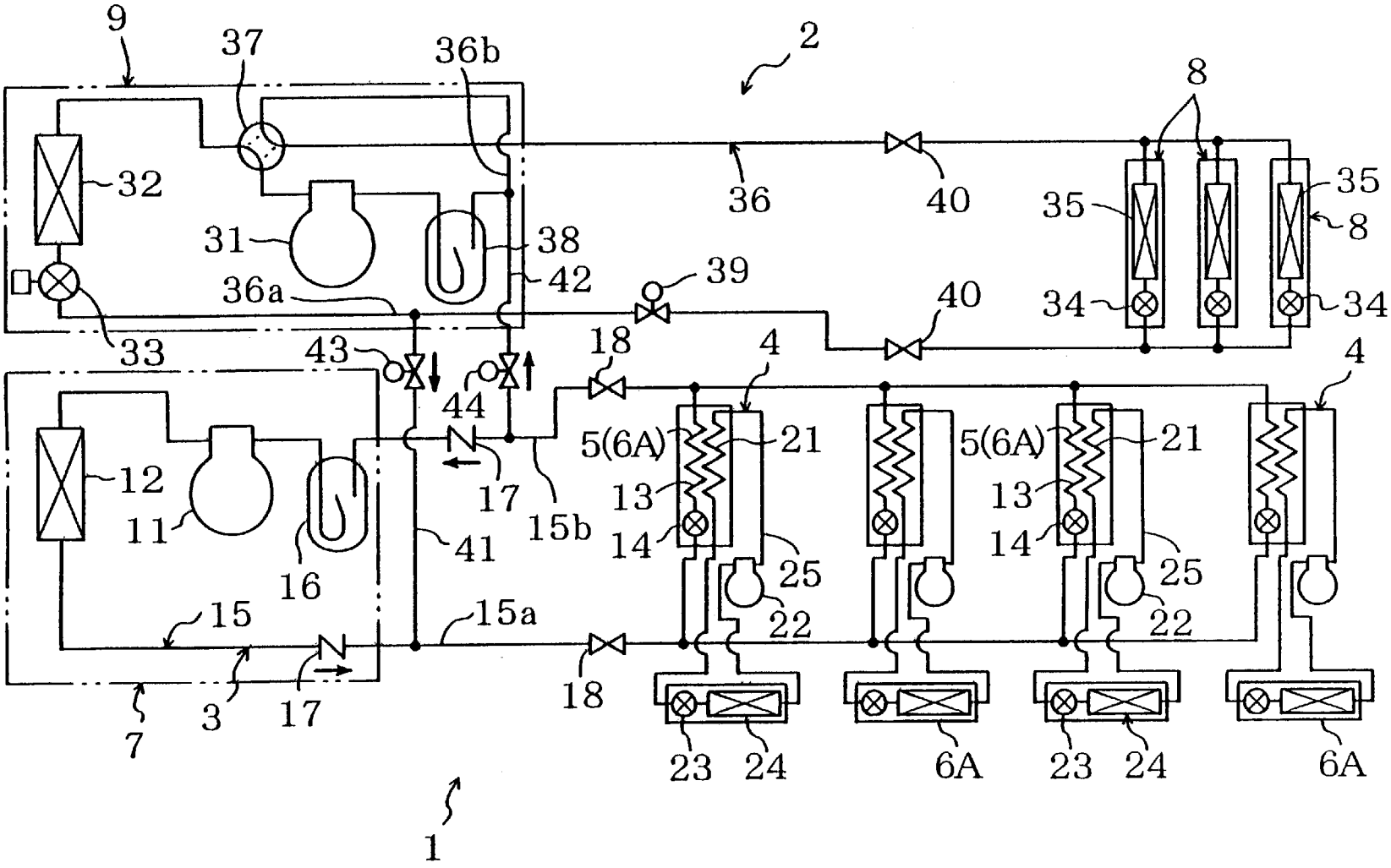
FIG. 1 is a circuit diagram of a refrigeration system according to a first embodiment of the present invention.

As shown in FIG. 1, a refrigeration system according to the first embodiment has a first refrigeration circuit (1) and a second refrigeration circuit (2). The first refrigeration circuit (1) is formed into a two-stage cascade refrigerating cycle of the vapor compression type by establishing connection between a high-temperature side refrigerant circuit (3) and a low temperature-side refrigerant circuit (4) through a refrigerant heat exchanger (5), whereas the second refrigeration circuit (2) is formed into a single-stage refrigerating cycle of the vapor-compression type. Moreover, the first refrigeration circuit (1) is constituted as a refrigeration circuit for a refrigerating apparatus such as a freezing showcase (6A) or the like, whereas the second refrigeration circuit (2) is constituted as a refrigeration circuit for air conditioning apparatus.

The first refrigeration circuit (1) comprises a heat source unit (7) having a compressor (11) and a heat source-side heat exchanger (12) and a plurality of the refrigerant heat exchangers (5) connected in parallel with respect to the heat source unit (7). Each of the refrigerant heat exchangers (5) includes an evaporation portion (13) for the high temperature-side refrigerant circuit (3) and a condensation portion (21) for the low temperature-side refrigerant circuit (4) which are integrally formed, and an expansion valve (14) is disposed on the upstream side of the evaporation portion (13).

The high temperature-side refrigerant circuit (3) is formed into a closed circuit by establishing connection of the compressor (11) and the heat source-side heat exchanger (12) of the heat source unit (7) and the expansion valve (14) and the evaporation portion (13) on the side of the refrigerant heat exchanger (5) by a refrigerant line (15). Further, in the high temperature-side refrigerant circuit (3), the heat source unit (7) includes an accumulator (16) and a check valve (17), and reference numeral (18) indicates a joint of the refrigerant line (15).

The low temperature-side refrigerant circuit (4) is formed into a closed circuit by establishing connection of a compressor (22), a condensation portion (21) of the refrigerant heat exchanger (5), an expansion valve (23), and an application-side heat exchanger (24) by a refrigerant line (25).

In the first embodiment, in addition to the provision of the application-side heat exchanger (24) in an air passage of the showcase (6A), the refrigerant heat exchanger (5) is provided in the air passage of the showcase (6A). These heat exchangers (5, 24) are able to provide a supply of cooled air to a display space within the showcase (6A) for foods or the like with the aid of an air blower not shown in the figure.

On the other hand,.the second refrigeration circuit (2) is formed into a closed circuit by establishing connection of a compressor (31), an outdoor heat exchanger (32), an outdoor expansion valve (33), an indoor expansion valve (34), and an indoor heat exchanger (35) by a refrigerant line (36). Further, disposed in the refrigerant line (36) on the discharge side of the compressor (31) is a four-way selector valve (37) operable to switch the direction of refrigerant circulation between the normal cycle for cooling operation and the reverse cycle for heating operation.

The indoor expansion valve (34) and the indoor heat exchanger (35) are provided in an indoor unit (8). Each indoor unit (8) is connected in parallel with respect to an outdoor unit (9) which includes the compressor (31), the outdoor heat exchanger (32), and the expansion valve (33). The outdoor unit (9) further includes an accumulator (38). Moreover, in the second refrigeration circuit (2), reference numeral (39) indicates a solenoid valve and reference numeral (40) indicates a joint of the refrigerant line (36).

In the first and second refrigeration circuits (1, 2), a liquid piping line (15*a*) of the high temperature-side refrigerant circuit (3) and a liquid piping line (36*a*) of the second refrigeration circuit (2) are connected together by a first connection piping line (41), and a suction-side gas piping line (15*b*) of the high temperature-side refrigerant circuit (3) and a suction-side gas piping line (36*b*) of the econd refrigeration circuit (2) are connected together by a econd connection piping line (42). Further, the first connection piping line (41) and the second connection piping line (42) are provided with their respective solenoid valves 43) and (44) serving as switching means for selective circulation of a refrigerant of the second refrigeration circuit (2) to the refrigerant heat exchanger (5) of the first refrigeration circuit (1) through each of the connection piping lines (41, 42).

Next, the running operation of the present refrigeration system will be described below.

Figure 2:
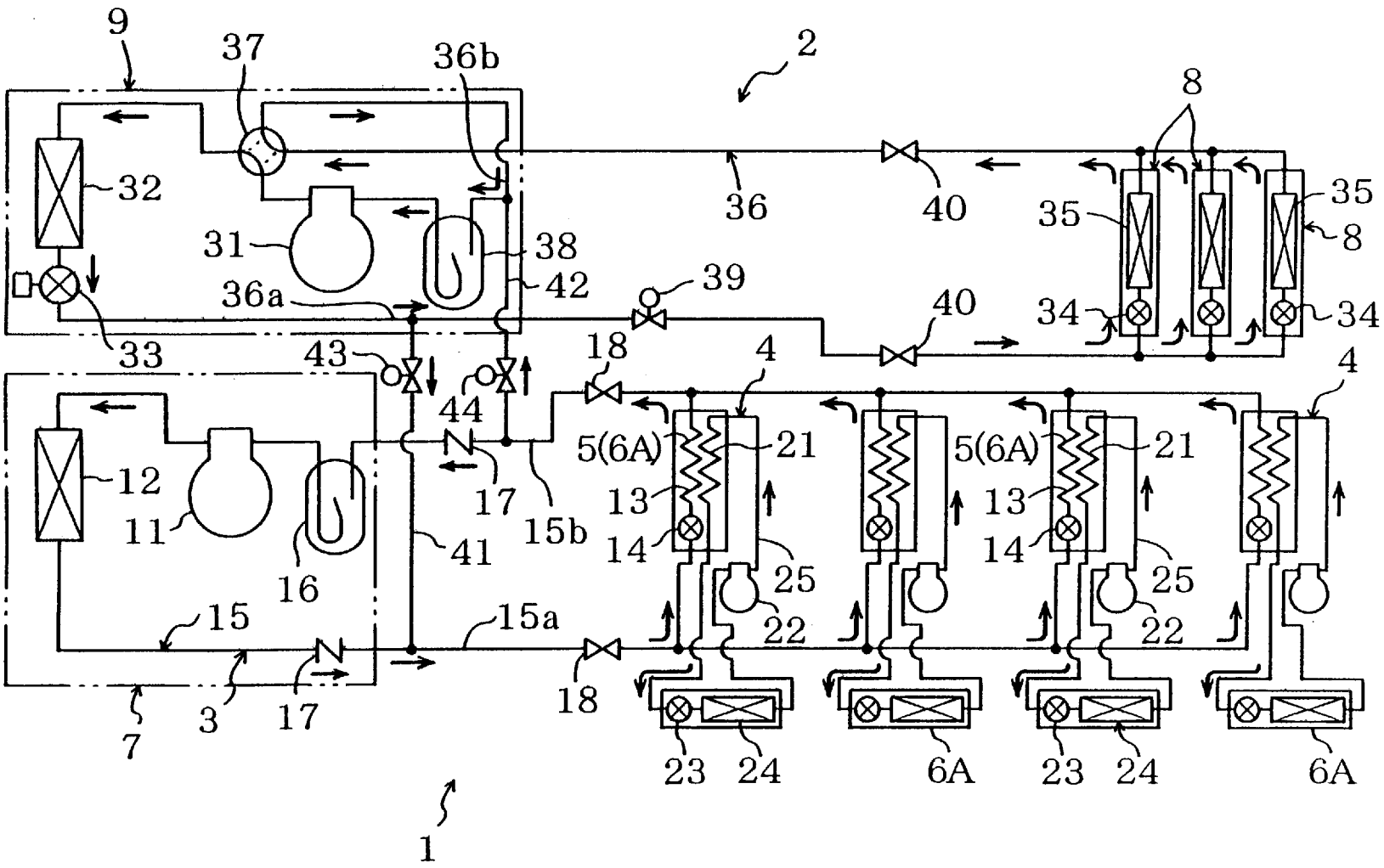
FIG. 2 is a diagram illustrating a first operation state of the refrigeration system of FIG. 1.
Figure 3:
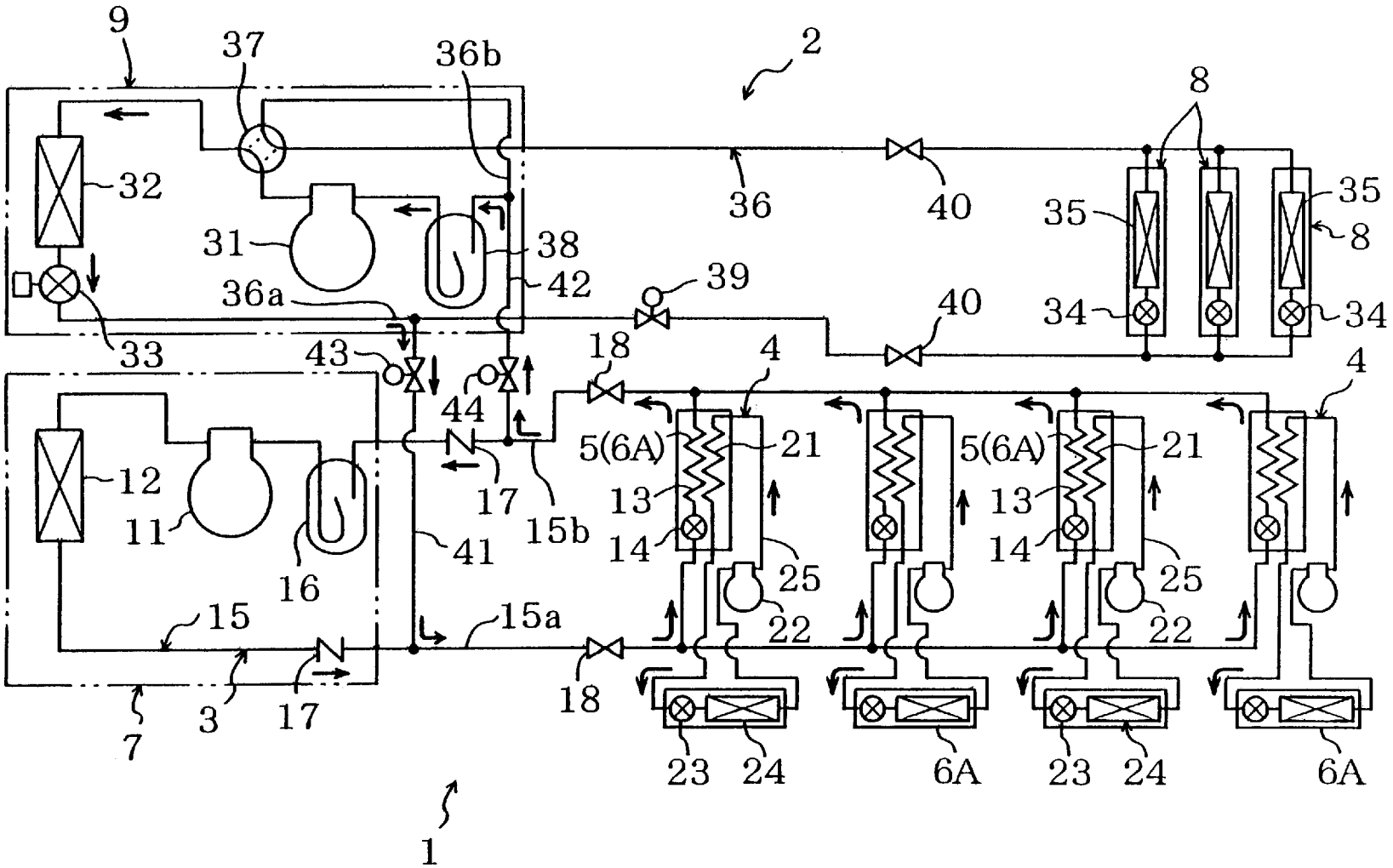
FIG. 3 is a diagram illustrating a second operation state of the refrigeration system of FIG. 1.
Figure 4:
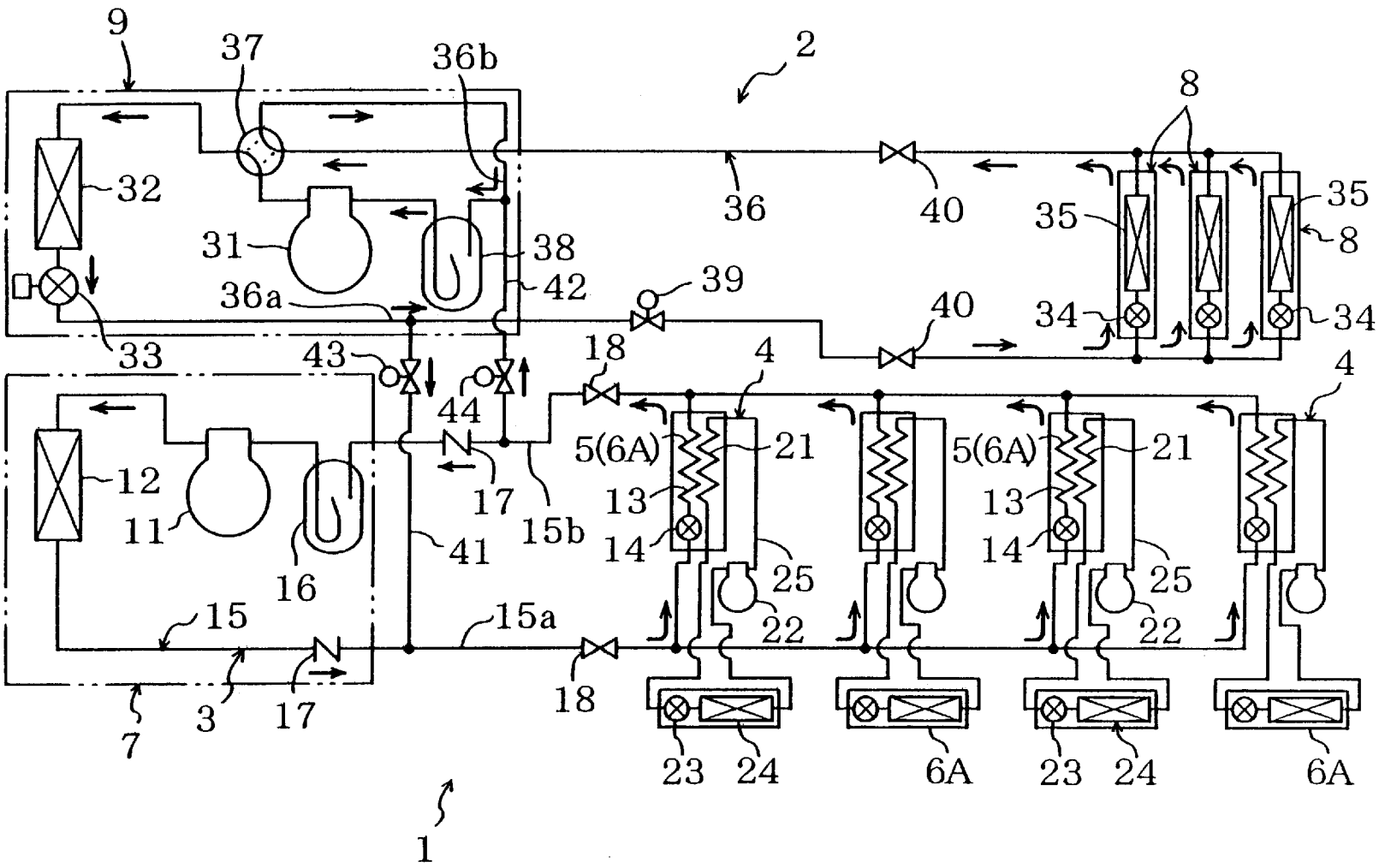
FIG. 4 is a diagram illustrating a third operation state of the refrigeration system of FIG. 1.

Referring to FIGS. 2–4, there are shown states in which the second refrigeration circuit (2) is in a cooling mode of operation. FIG. 2 shows a state in which both the refrigeration circuits (1, 2) operate normally.

At this time, in the second refrigeration circuit (2), the outdoor expansion valve (33) is fully open and the indoor expansion valve (34) is subjected to open control (for example, for the degree of superheat). The solenoid valve (39) is in its open state and, on the other hand, both the solenoid valves (43, 44) disposed in the connection piping lines (41, 42) are in their closed state. A high pressure gas refrigerant, discharged from the compressor (31), enters the outdoor heat exchanger (32) through the four-way selector valve (37). In the outdoor heat exchanger (32), the refrigerant condenses to undergo liquefaction. The resulting liquid refrigerant is decompressed in the indoor expansion valve (34), thereafter cools indoor air at the indoor heat exchanger (35) to evaporate back again to a gas refrigerant, and then returns to the compressor (31). Such a circulation is repeatedly carried out, whereby the room is cooled.

On the other hand, in the first refrigeration circuit (1), refrigerants circulate in the high temperature-side refrigerant circuit (3) and in each low temperature-side refrigerant circuit (4), and in each refrigerant heat exchanger (5) heat exchange is carried out between the refrigerants of the refrigerant circuits (3, 4). In the low temperature-side refrigerant circuit (4), the refrigerant, which has been condensed in the condensation portion (21) of the refrigerant heat exchanger (5) to undergo liquefaction, is decompressed in the expansion valve (23), thereafter being evaporated in the application-side heat exchanger (24) to cool air in the showcase (6A). In this way, refrigerating operations of two-stage cascade refrigerating cycle are carried out in each showcase (6A), whereby foods or the like in each showcase (6A) can be preserved at a predetermined low temperature.

Referring to FIG. 3, there is illustrated a running operation when the heat source unit (7) of the first refrigeration circuit (1) stops operating due to failure or the like. At this time, the solenoid valves (43, 44) are placed in their open state and the solenoid valve (39) is placed in its closed state, in order to provide a supply of refrigerant from the compressor (31) of the second refrigeration circuit (2) to the evaporation portion (13) of each refrigerant heat exchanger (5) of the first refrigeration circuit (1). The closing of the solenoid valve (39) brings the cooling operation to a stop. However, if it is arranged such that refrigerant is allowed to flow towards the indoor unit (8) by not fully closing the solenoid valve (39), this will make it possible to continue the cooling operation although there is a drop in the cooling capacity.

In a state as shown in FIG. 3, a gas refrigerant, discharged from the compressor (31) of the second refrigeration circuit (2), changes to a liquid refrigerant in the outdoor heat exchanger (32), thereafter being delivered, by way of the expansion valve (33) in its full open state and the solenoid valve (43), to the evaporation portion (13) of each refrigerant heat exchanger (5). The refrigerant, which has been gasified as a result of heat exchange with a refrigerant of the low temperature-side refrigerant circuit (4) in each refrigerant heat exchanger (5), is drawn into the compressor (31) of the second refrigeration circuit (2) by way of the solenoid valve (44) and the accumulator (38) and, then, one cycle has now been completed. Further, in the low temperature-side refrigerant circuit (4), the refrigerant circulates, as in FIG. 2, as a consequence of which refrigeration operations of two-stage cascade refrigerating cycle are carried out for the respective showcases (6A), whereby the chamber inside of each showcase (6A) is maintained at a predetermined temperature.

Next, referring to FIG. 4, there is illustrated a running operation when the compressor (22) of the low temperature-side refrigerant circuit (4) in the first refrigeration circuit (1) stops operating due to failure or the like. At this time, the low temperature-side refrigerant circuit (4) stops. However, if it is arranged such that an air blower for the refrigerant heat exchanger (5) operates while refrigerant is being circulated in the high temperature-side refrigerant circuit (3), this causes heat exchange to take place between the refrigerant of the high temperature-side refrigerant circuit (3) and air. As a result, the air is cooled. The air thus cooled is then delivered to the chamber inside. In this case, the operation of the first refrigeration circuit (1) is limited to its high stage side, so that the temperature of the inside of the showcase (6A) somewhat increases; however, it is possible to temporarily prevent the freshness of foods or the like from dropping.

Further, even when in the first refrigeration circuit (1) both the compressor (11) of the high temperature-side refrigerant circuit (3) and the compressor (22) of the low temperature-side refrigerant circuit (4) stop operating, cooled air can be delivered, as in the above, to the chamber inside by operating an air blower for the refrigeration heat exchanger (5) while at the same time causing refrigerant to circulate between the compressor (31) of the second refrigeration circuit (2) and the refrigerant heat exchanger (5) of the first refrigeration circuit (1). As a consequence of the forgoing, it becomes possible to temporarily prevent the freshness of foods from dropping.

Figure 5:
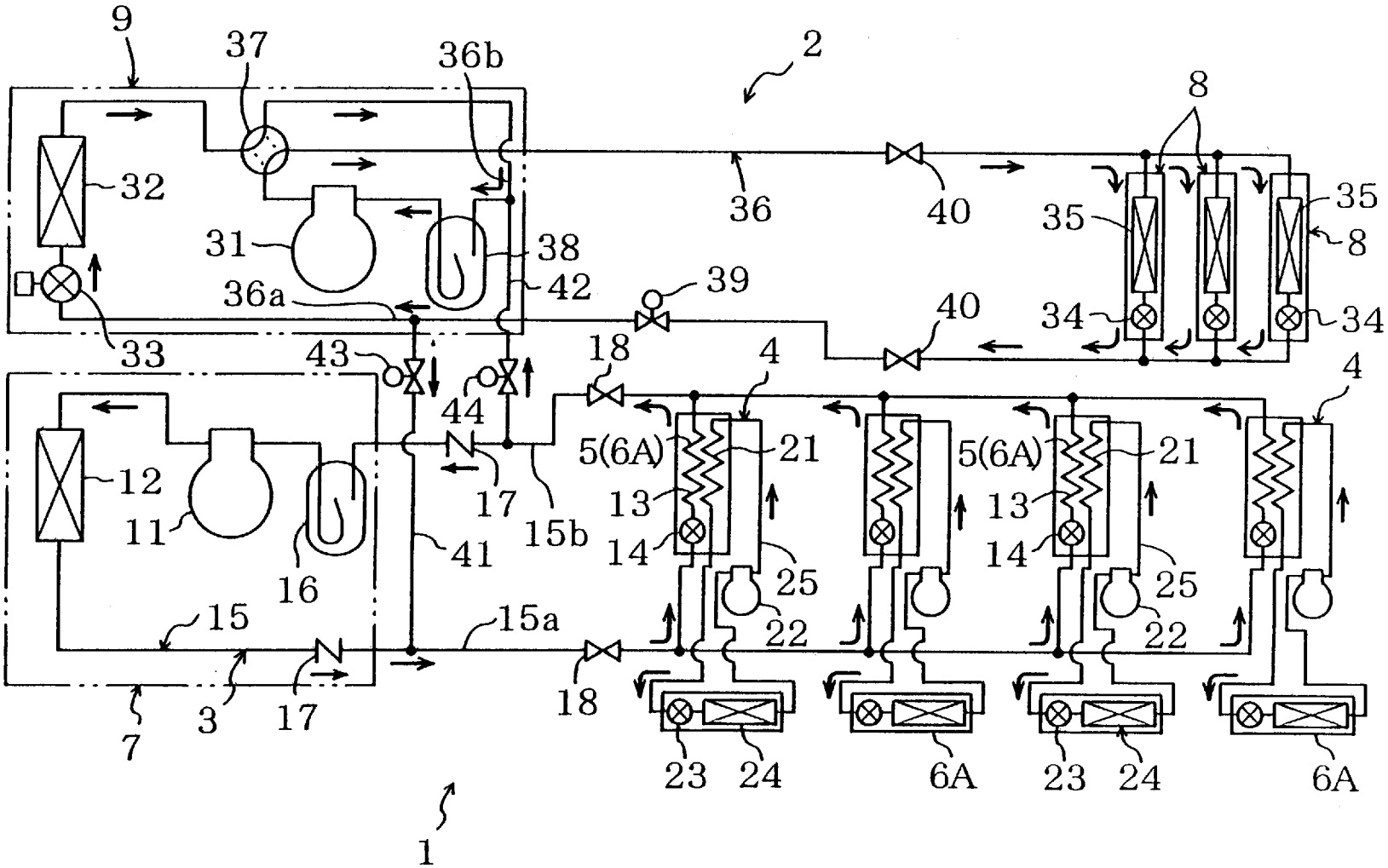
FIG. 5 is a diagram illustrating a fourth operation state of the refrigeration system of FIG. 1.
Figure 6:
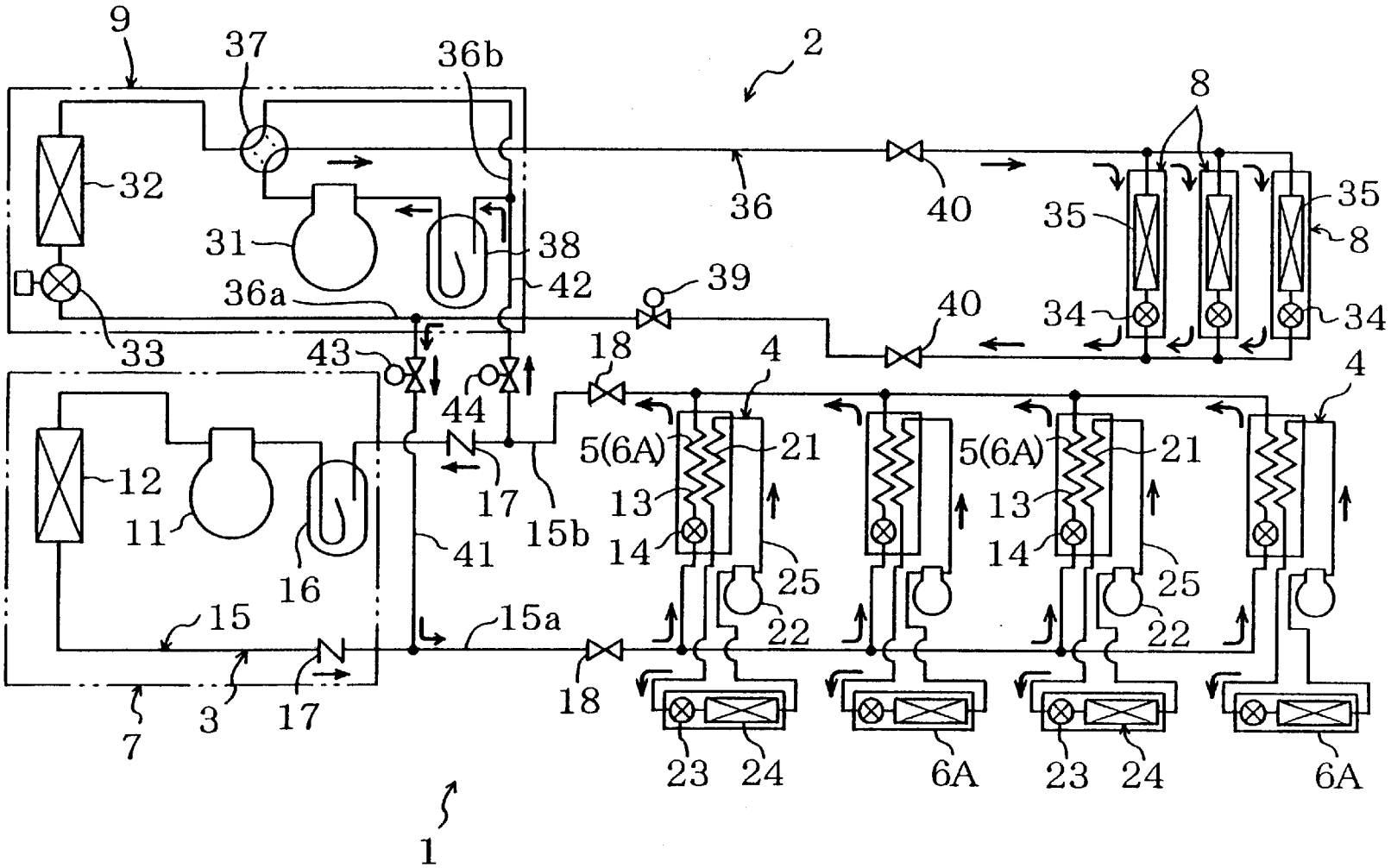
FIG. 6 is a diagram illustrating a fifth operation state of the refrigeration system of FIG. 1.
Figure 7:
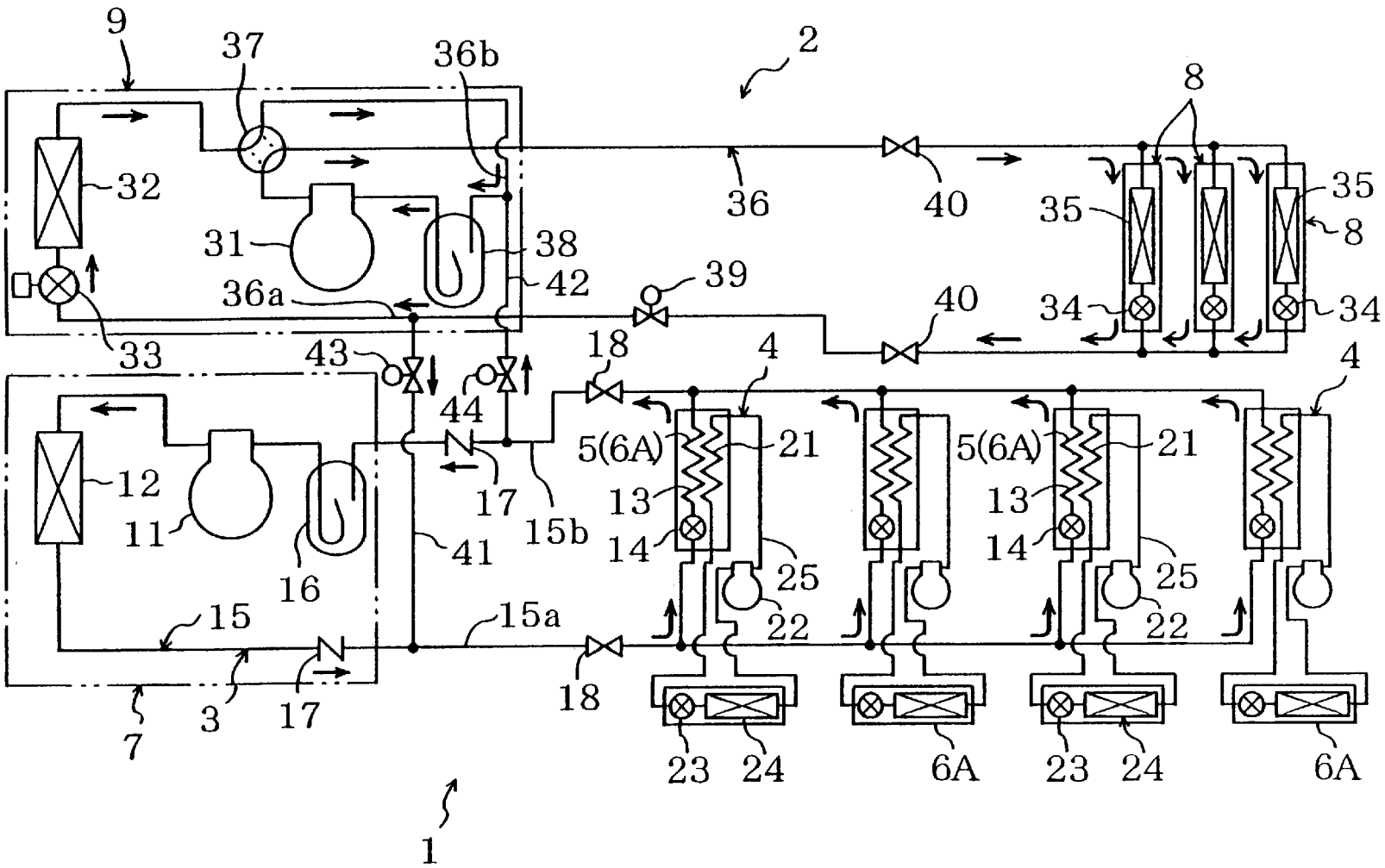
FIG. 7 is a diagram illustrating a sixth operation state of the refrigeration system of FIG. 1.

Referring to FIGS. 5–7, there are shown states in which the second refrigeration circuit (2) is in a heating mode of operation, and FIG. 5 illustrates a state in which both the refrigeration circuits (1, 2) operate normally.

At this time, in the second refrigeration circuit (2) the indoor expansion valve (34) is fully open and the outdoor expansion valve (33) is subjected to open control (for example, for the degree of superheat). Moreover, the solenoid valve (39) is in its open state, while on the other hand both the solenoid valves (43, 44) disposed in the connection piping lines (41, 42) are in their closed state. A high pressure gas refrigerant, discharged from the compressor (31), enters, by way of the four-way selector valve (37), into the indoor heat exchanger (35) whereat the refrigerant heat-exchanges with indoor air to condense and undergo liquefaction. The resulting heated air is blown into the room to heat it. Meanwhile, the liquid refrigerant, which has left the indoor heat exchanger (35), is decompressed in the outdoor expansion valve (33), thereafter being vaporized in the outdoor heat exchanger (32) to change back again to a gas refrigerant. The gas refrigerant returns to the compressor (31) through the four-way selector valve (37) and the accumulator (38). During the heating operation, the foregoing operation is repeatedly carried out.

Meanwhile, in the first refrigeration circuit (1), as in the cooling mode of operation, refrigerants are circulated in the high temperature-side refrigerant circuit (3) and in each low temperature-side refrigerant circuit (4), wherein in each refrigerant heat exchanger (5) heat exchange takes place between the refrigerants of the refrigerant circuits (3, 4). Further, in the low temperature-side refrigerant circuit (4), the refrigerant condenses in the refrigerant heat exchanger (5) to undergo liquefaction, is decompressed at the expansion valve (23), and is then vaporized in the application-side heat exchanger (24) to cool the air in the showcase (6A). In the way described above, two-stage cascade refrigerating cycle operations are carried out for each showcase (6A), whereby foods or the like stored in each showcase (6A) are maintained at a predetermined low temperature.

Referring to FIG. 6, there is illustrated a running operation when the heat source unit (7) of the first refrigeration circuit (1) stops operating due to failure or the like. A refrigerant of the second refrigeration circuit (2) passes through the indoor heat exchanger (35) to heat indoor air. Thereafter, the refrigerant is delivered, through the solenoid valves (39, 43), to the evaporation portion (13) of the refrigerant heat exchanger (5) of the first refrigerant circuit (1) for heat exchange with a refrigerant of the low temperature-side refrigerant circuit (4) flowing in the condensation portion (21) to change to a gas refrigerant. Thereafter, the gas refrigerant passes through the solenoid valve (44) and the accumulator (38) to return back again to the compressor (31) of the second refrigeration circuit (2). During this running operation, the outdoor expansion valve (33) is controlled to enter its fully closed state in order to prevent refrigerant from flowing into the outdoor heat exchanger (32).

At this time, like FIG. 5, there is a circulation of refrigerant in the low temperature-side refrigerant circuit (4). Accordingly, two-stage cascade refrigerating cycle operations are carried out for each showcase (6A), whereby each showcase (6A) is maintained at a predetermined temperature. Additionally, in this case there is the advantage that it is possible to continuously perform heating operations as well.

Referring to FIG. 7, there is illustrated a running operation when the compressor (22) of the low temperature-side refrigerant circuit (4) in the first refrigeration circuit (1) stops operating due to failure or the like. At this time, the running operation of the first refrigeration circuit (1) is the same as the one shown in FIG. 4, and by operating an air blower for the refrigerant heat exchanger (5) while causing refrigerant to circulate in the high temperature-side refrigerant circuit (3), heat exchange is made to take place between the refrigerant of the high temperature-side refrigerant circuit (3) and air. As a result, the air is cooled and the cooled air is delivered to the chamber inside. Also in this case, as in the example of FIG. 4, the operation of the first refrigeration circuit (1) is limited to its high stage side. Accordingly, although the temperature of the inside of the showcase (6A) somewhat increases, it is possible to temporarily prevent the freshness of foods or the like in the showcase (6A) from dropping.

Further, even when in the first refrigeration circuit (1) both the compressor (11) of the high temperature-side refrigerant circuit (3) and the compressor (22) of the low temperature-side refrigerant circuit (4) stop operating, cooled air can be delivered to the chamber inside by operating an air blower for the refrigerant heat exchanger (5) of the first refrigeration circuit (1) while causing the refrigerant, which has passed through the indoor heat exchanger (35) from the compressor (31) Of the second refrigeration circuit (2), to circulate in the refrigerant heat exchanger (5). As a consequence of the forgoing, it becomes likewise possible to temporarily prevent the freshness of foods from dropping.

In accordance with the first embodiment, even when, for example, in a convenience store, the compressor (11) of the high temperature-side refrigerant circuit (3) stops operating, it is possible to continuously provide a supply of cooled air to the chamber inside of the showcase (6A) by making utilization of the second refrigeration circuit (2) for air conditioning apparatus. This means that the quality of goods can be maintained without having to transfer them into another showcase.

Moreover, even when the compressor (22) of the low temperature-side refrigerant circuit (4) stops operating, it is possible to temporarily prevent the quality of foods or the like from dropping by operating an air blower while causing either a refrigerant of the high temperature-side refrigerant circuit (3) or a refrigerant of the second refrigeration circuit (2) for air conditioning to flow in the evaporation portion (13) of the refrigerant heat exchanger (5).

In relatively small stores such as a convenience store, one heat source equipment is generally provided for each refrigerating apparatus, such as the freezing showcase (6A) and a cold storage showcase. Accordingly, when one of the heat source equipment is out of order, then only one of the showcases is available, i.e., only one of the temperature zones is available. For this reason, when the heat source equipment on the freezing side is out of order, the stored goods will not be well preserved for a long period of time even when transferred to the cold storage showcase. In accordance with the first embodiment, however, the heat source equipment (31) for air conditioning apparatus is utilized to enable continuation of two-stage cascade refrigerating cycle operation. This therefore enables at least the freezing showcase (6A) to continue its operations, which is effective for the preservation of goods.

In the first embodiment, in addition to each application-side heat exchanger (24), each refrigerant heat exchanger (5) is also disposed in the air passage of the showcase (6A). However, depending upon the situation, such a configuration may be employed that the refrigerant heat exchanger (5) is located outside the showcase (6A) so as not to be served for the cooling of the inside of the showcase (6A).

Further, in the foregoing first embodiment, the first refrigeration circuit (1) is constructed for the freezing showcase (6A). However, in the first refrigeration circuit (1), an arrangement may be made in which there exists a mixture of a cold storage showcase and a so-called boiled-rice showcase for packed lunch, rice ball, and cooked bread. Since these showcases are cold storage apparatus having a temperature zone somewhat higher than that of the freezing showcase (6A), a single-stage refrigerating cycle circuit may be mixed in the first refrigeration circuit (1).

Figure 8:
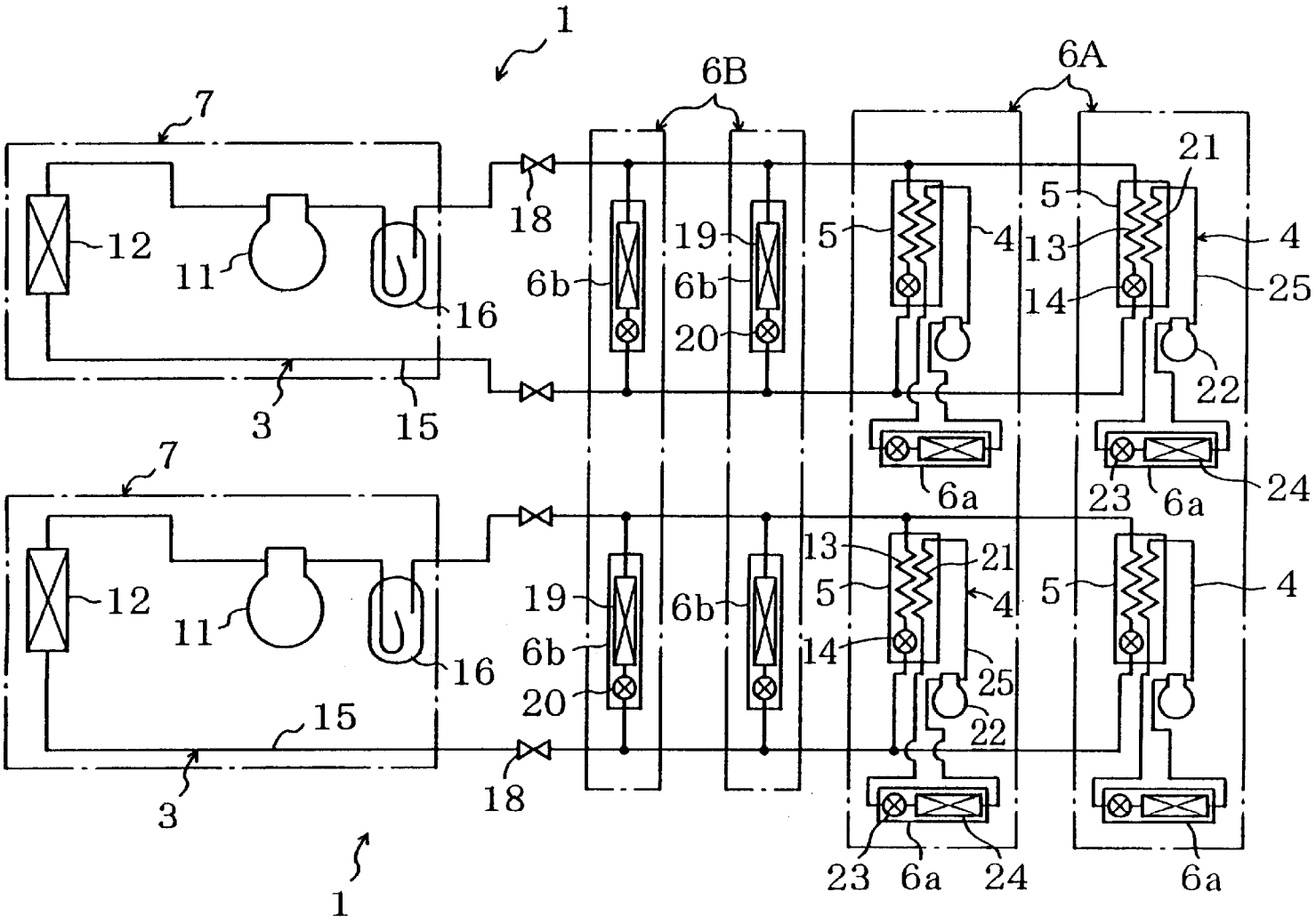
FIG. 8 is a circuit diagram of a refrigeration system according to a second embodiment of the present invention.

More specifically, in the first refrigeration circuit (1), in order to perform a single-stage refrigerating cycle by sharing the compressor (11) of the high temperature-side refrigerant circuit (3) and the heat source-side heat exchanger (12), an application-side heat exchanger (see reference numeral (19) of FIG. 8) is connected, in parallel with the refrigerant heat exchanger (5), to the compressor (11) and the heat source-side heat exchanger (12).

As a result of such arrangement, even when the heat source unit (7) of the first refrigeration circuit (1) stops operating, if it is arranged for refrigerant to flow from the second refrigeration circuit (2), this allows, not only the freezing showcase (6A) but also the cold storage showcase, to continue operating, whereby the foods or the like can be preserved continuously at an adequate temperature.

Further, in the foregoing first embodiment, the second refrigeration circuit (2) is formed into a single-stage refrigerating cycle, which is however not considered to be restrictive. The second refrigeration circuit (2) may be formed into any other cycle (e.g., a two-stage cascade refrigerating cycle) as long as it is a refrigerating cycle different from that of the first refrigeration circuit (1).

Furthermore, for example, in the running state shown in FIG. 6 of the first embodiment (i.e., in the state in which the heat source unit (7) of the high temperature-side refrigerant circuit (3) stops operating in a heating mode of operation), it may be arranged such that the direction in which a refrigerant circulates is reversed to cause the refrigerant to condense in the outdoor heat exchanger (32) during thermo-off operation (a halt of refrigerating operation). Moreover, when the compressor (11) of the first refrigeration circuit (1) is out of order during heating operation, it is possible to use the outdoor heat exchanger (32) as a condenser by giving up air conditioning.

As shown in FIG. 8, in a second embodiment of the present invention a plurality of refrigeration circuits (1) for refrigerating apparatus are provided, each of the refrigeration circuits (1) having a structure in which a two-stage cascade refrigerating cycle refrigeration circuit and a single-stage refrigerating cycle refrigeration circuit coexist. In other words, each refrigeration circuit (1) is formed into a two-stage cascade refrigerating cycle by forming connection of a high temperature-side refrigerant circuit (3) and a low temperature-side refrigerant circuit (4) through a refrigerant heat exchanger (5) and the high temperature-side refrigerant circuit (3) has an application-side heat exchanger (19) connected in parallel with the refrigerant heat exchanger (5). Disposed on the upstream side of the application-side heat exchanger (19) is an expansion valve (20).

The high temperature-side refrigerant circuit (3) is formed by connecting two refrigerant heat exchangers (5) and two application-side heat exchangers (19) in parallel with respect to the heat source unit (7) including the compressor (11) and the heat source-side heat exchanger (12). Since the low temperature-side refrigerant circuit (4) has the same structure as the first embodiment, its description is omitted here accordingly.

In the second embodiment, a total of two application-side heat exchangers (19) (one application-side heat exchanger (19) included in the high temperature-side refrigerant circuit (3) of one refrigeration circuit (1) and one application-side heat exchanger (19) of the other refrigeration circuit (1)) are disposed in each cold storage showcase (6B) integrally formed as indicated by a virtual line, each being able to provide a supply of air into its chamber with the aid of an air blower (not shown in the figure). Further, a total of two second application-side heat exchangers (24) (a second application-side heat exchanger (24) included in the low temperature-side refrigerant circuit (4) of one refrigeration circuit (1) and a second application-side heat exchanger (24) of the other refrigeration circuit (1)) are disposed in each freezing showcase (6A) integrally formed as indicated by a virtual line, each being able to provide a supply of air into its chamber with the aid of an air blower (not shown in the figure).

In the figure, the freezing showcase (6A) contains therein the refrigerant heat exchangers (5) and the low temperature-side compressors (22) of the refrigeration circuits (2). However, the equipments (5, 22) may be disposed exterior to the freezing showcase (6A).

In the second embodiment, for each refrigeration circuit (1), the compressor (11) is operated so that in the freezing and cold storage showcases (6A, 6B) air at adequate temperature is blown into each chamber inside, whereby food preservation by freezing and food preservation by cold storage can be carried out at the same time.

With such an arrangement, even when the heat source unit (7) of either one of the refrigeration circuits (1) is out of order, it is possible to allow both the freezing showcase (6A) and the cold storage showcase (6B) to continue operating by the other refrigeration circuit (1), whereby in a store such as a convenience store the running operation of each showcase (6A, 6B) can be continued.

In accordance with the second embodiment, even when the heat source unit (7) of either one of the refrigeration circuits (1) stops operating, each showcase (6A, 6B) is able to continue operating. It is therefore possible to maintain the quality of foods without having to move them into another showcase. Particularly, since both the showcases (6A, 6B) of different temperature zones remains in operation, this eliminates the inconvenience of preserving, when the freezing showcase (6A) stops operating, the foods in the cold storage showcase (6B).

In the second embodiment, each showcase (6A, 6B) has two application-side heat exchangers, namely an application-side heat exchanger (19, 24) of one of the refrigeration circuits (1) and an application-side heat exchanger (19, 24) of the other refrigeration circuit (1). However, an arrangement may be made in which a single showcase is provided with a single application-side heat exchanger (19, 24). In such a case, a unit denoted by reference numeral (6*a*, 6*b*) corresponds to each showcase. Even when employing such arrangement, if two refrigeration circuits (1) are provided in a store, this makes it possible to allow the showcases (6*a*, 6*b*) of different temperature zones to continue operating even when the heat source unit (7) of either one of the refrigeration circuits (1) stops operating.

What is claimed is:

1. A refrigeration system comprising:

a first refrigeration circuit (1) for a refrigerating apparatus (6A), said first refrigeration circuit (1) being formed into a two-stage cascade refrigerating cycle by establishing connection between a high temperature-side refrigerant circuit (3) and a low temperature-side refrigerant circuit (4) through a refrigerant heat exchanger (5); and a second refrigeration circuit (2) which is formed into a refrigerating cycle different from that of said first refrigeration circuit (1);

wherein a liquid piping line (15*a*) of said high temperature-side refrigerant circuit (3) and a liquid piping line (36*a*) of said second refrigeration circuit (2) are connected together through a first connection piping line (41) and wherein a suction-side gas piping line (15*b*) of said high temperature-side refrigerant circuit (3) and a suction-side gas piping line (36*b*) of said second refrigeration circuit (2) are connected together through a second connection piping line (42);

said refrigeration system further comprising:

switching means (43, 44) for selective circulation of a refrigerant of said second refrigeration circuit (2) to said refrigerant heat exchanger (5) of said first refrigeration circuit (1) through each of said connection piping lines (41, 42).

2. The refrigeration system of claim 1, wherein said second refrigeration circuit (2) is a refrigeration circuit for air conditioning apparatus.

3. The refrigeration system of claim 1, wherein said refrigerant heat exchanger (5) is able to provide a supply of air to the chamber inside of said refrigerating apparatus (6A) by means of an air blower.

4. The refrigeration system of claim 1, wherein said first refrigeration circuit (1) has an application-side heat exchanger (19) connected in parallel to said refrigerant heat exchanger (5).

5. The refrigeration system of claim 1, wherein said second refrigeration circuit (2) is formed into a singlestage refrigerating cycle.

6. A refrigeration system comprising a plurality of refrigeration circuits (1) for refrigerating apparatus (6A, 6B), wherein each of said refrigeration circuits (1) is formed into a two-stage cascade refrigerating cycle by establishing connection between a high temperature-side refrigerant circuit (3) and a low temperature-side refrigerant circuit (4) through a refrigerant heat exchanger (5) and wherein said high temperature-side refrigerant circuit (3) has an application-side heat exchanger (19) connected in parallel to said refrigerant heat exchanger (5);

wherein said application-side heat exchangers (19) included in said high temperature-side refrigerant circuits (3) of said plurality of refrigeration circuits (1) each are able to provide a supply of air to the chamber inside of one refrigerating apparatus (6B) by means of an air blower; and wherein second application-side heat exchangers (24) included in said low temperature-side refrigerant circuits (4) of said plurality of refrigeration circuits (1) each are able to provide a supply of air to the chamber inside of the other refrigerating apparatus (6A) by means of an air blower.

* * * * *

UNITED STATES PATENT AND TRADEMARK OFFICE

CERTIFICATE OF CORRECTION

PATENT NO. : 6,298,683 B1 
DATED : October 1, 2001
INVENTOR(S) : Isao Kondo, Akitoshi Ueno and Takenori Mezaki It is certified that error appears in the above-identified patent and that said Letters Patent is hereby corrected as shown below:

Title page,
Item [54], the title, should read "REFRIGERATION SYSTEM";
Item [22], PCT Filed, should read -- Dec. 14, 1999 --.

Signed and Sealed this

Eleventh Day of June, 2002

*Attest:*

*Attesting Officer*

JAMES E. ROGAN
*Director of the United States Patent and Trademark Office*